US006047751A

United States Patent [19]

An

[11] Patent Number: 6,047,751

[45] Date of Patent: Apr. 11, 2000

[54] METHOD AND APPARATUS FOR INCREASING THE HARDNESS AND INTENSITY OF WOOD

[76] Inventor: Sun-Tae An, 401 Suksan Apt, Guseo 1-Dong, Kumjung-Gu, Pussan, Rep. of Korea, 609-311

[21] Appl. No.: 09/266,032

[22] Filed: Mar. 11, 1999

[30] Foreign Application Priority Data

Mar. 11, 1998 [KR] Rep. of Korea ..... 98/008909

[51] Int. Cl.[7] ..... B27M 1/02

[52] U.S. Cl. ..... 144/361; 144/2.1; 144/329; 144/359; 264/280; 264/284; 264/325; 264/405

[58] Field of Search ..... 100/269.01, 269.05; 144/2.1, 329, 361, 359, 362, 380, 381, 364; 264/239, 280, 284, 319, 320, 323, 325, 405, 453; 428/106, 109

[56] References Cited

U.S. PATENT DOCUMENTS

| | | | |
|---|---|---|---|
| 987,368 | 3/1911 | Hyatt | 144/359 |
| 1,480,658 | 1/1924 | Bostock | 144/361 |
| 1,644,801 | 10/1927 | Van der Werff | 144/361 |
| 3,224,428 | 12/1965 | Egbert | 144/359 |
| 5,190,088 | 3/1993 | Thompssen et al. | 144/380 |
| 5,685,353 | 11/1997 | Viitaniemi et al. | 144/380 |

*Primary Examiner*—W. Donald Bray

[57] ABSTRACT

A device for increasing the hardness and intensity of wood which comprises chuck means for holding the wood in a fixed position for processing, a compression-shaped forming die for compressing the wood being processed, an ultrasonic wave-generating device operatively connected with the compression-shaped forming die for applying sound waves to the wood, a forming mold positioned downstream of said compression-shaped forming die for receiving wood therefrom, said forming mold further compressing said wood to remove a portion of the water contained therein, and means for advancing the chuck means containing the wood being processed through the compression-shaped forming die, the ultrasonic wave-generating device and the forming mold.

13 Claims, 4 Drawing Sheets

METHOD AND APPARATUS FOR INCREASING THE HARDNESS AND INTENSITY OF WOOD

FIELD OF THE INVENTION

The present invention relates to a compression method and apparatus for increasing the hardness and intensity of a wood, and more particularly to a compression method and apparatus capable of enhancing the quality of a wood product by reprocessing a log to increase the hardness of the wood.

BACKGROUND OF THE INVENTION

Generally, to prevent wooden products from being transformed into components having crevices, distortions, etc., the water contained in the wood has to be substantially removed during the processing of the exploited log.

Convention wood processing method used a natural drying method or an artificial drying method for reducing the percentage of water contained in the wood. But these methods require much drying time for the wood, thereby causing the cost of the product to be increased.

In the present invention, the water contained in the wood is uniformly removed through a special reprocessing process without using conventional drying methods. Thus, the wood fiber is regularly contracted without being destroyed, whereby the density of the wood is increased. Accordingly, the present invention has advantages capable of improving the reprocessing of the wood and preventing a waste of wood resources caused by flaws in the product.

SUMMARY OF THE INVENTION

Wood harvested from growing trees contains a maximum amount of water in the fiber thereof. The fiber containing the water is laid in a continuous distribution state which defines minute water storages.

In the case of providing a maximum drying of the water contained in the wood, since the water storages become empty, the density of the fiber is lowered, and accordingly the hardness of the wood is reduced.

Due to such a characteristic of the wood, the hardness and durability of the wooden product may be weakened and therefore it is preferable that the wood possesses a low percentage of water and a high density.

Accordingly, an object of the present invention is to provide a compression method and apparatus for increasing the hardness and the intensity of wood while eliminating the formation of crevices and distortions, etc., occurring in the wood due to the evaporation of the water form the wood wherein a wood product is compressed to reduce the volume thereof, and simultaneously the water contained in the fiber is extracted while forcedly pushing the wood into a compression-shaped forming device to reduce the volume thereof. The compression of the wood is facilitated by the application of sound-wave generation to the wood and the use of a rotational device in the conveyance of the wood.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENT

Figure 1:
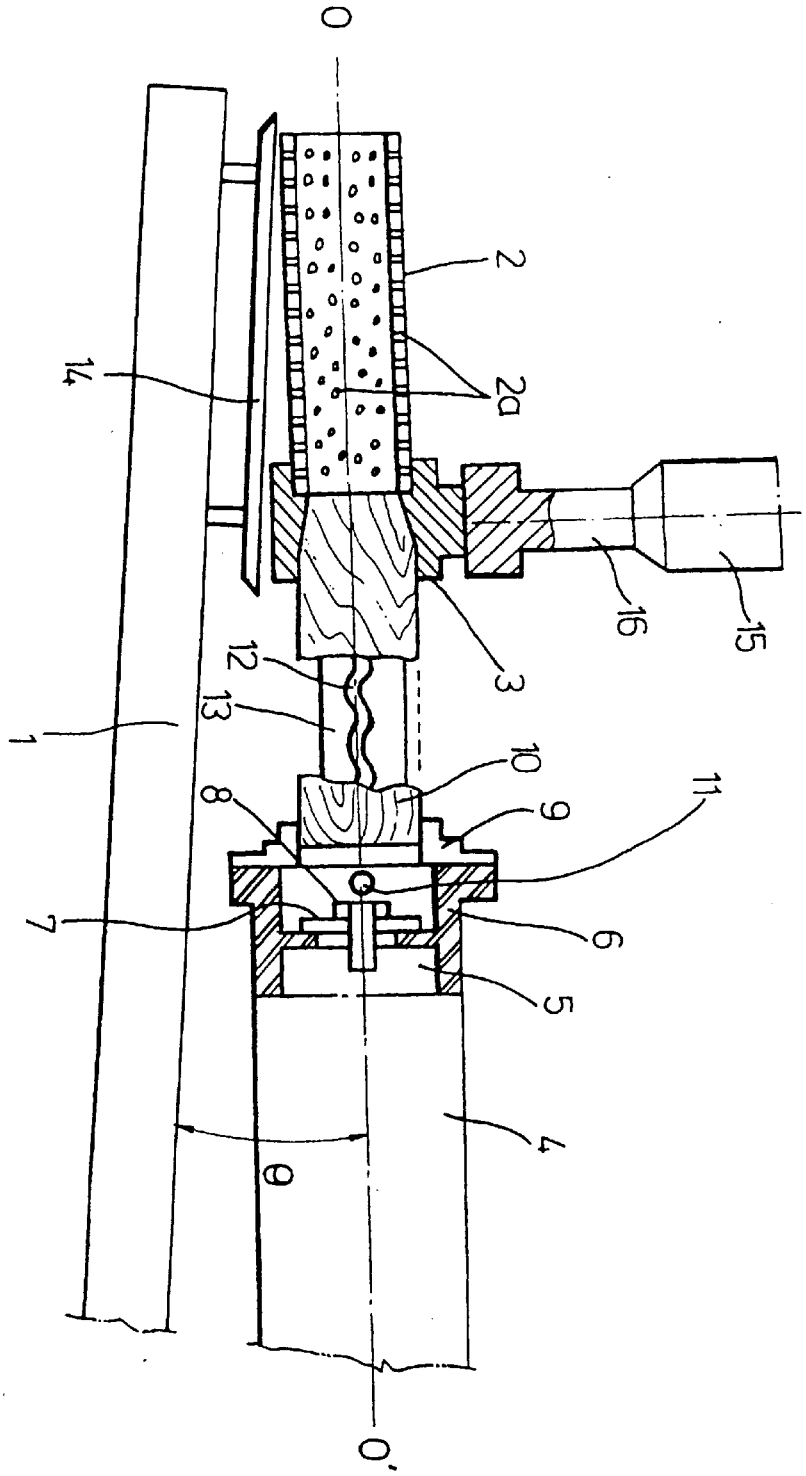
FIG. 1 is a sectional view of a device in accordance with the present invention.
Figure 2:
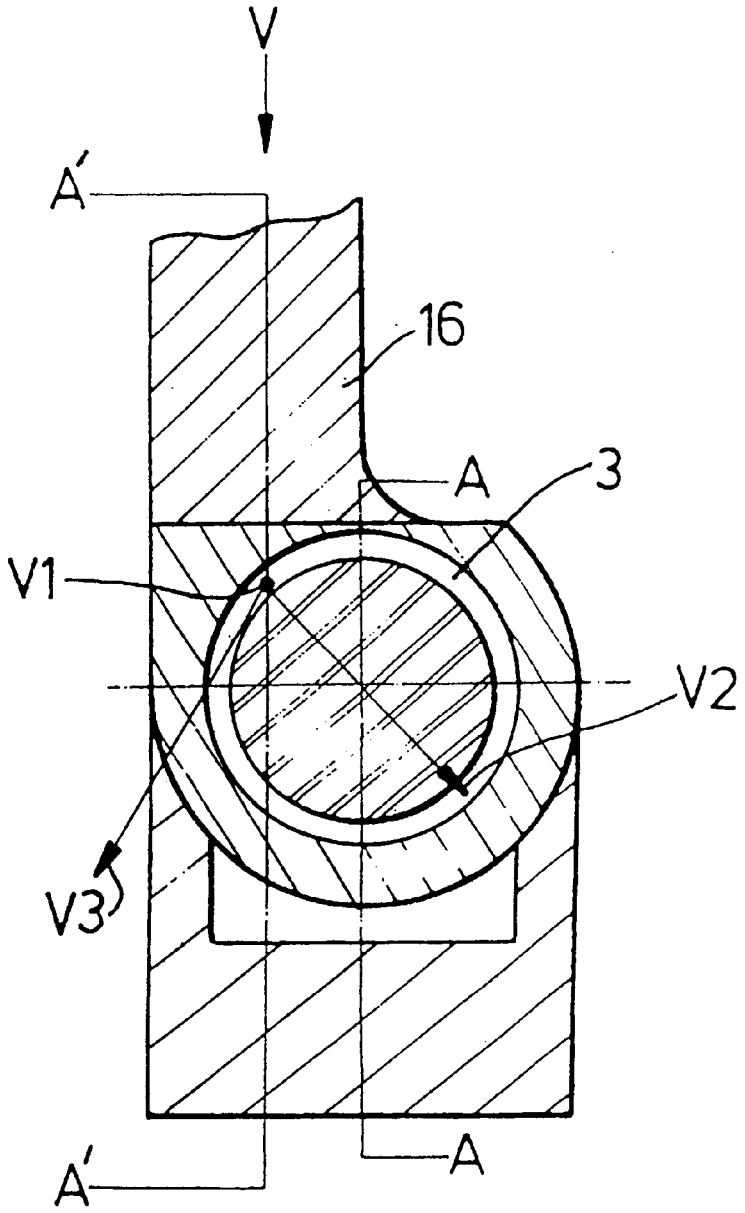
FIG. 2 is a longitudinal sectional view of FIG. 1.
Figure 3:
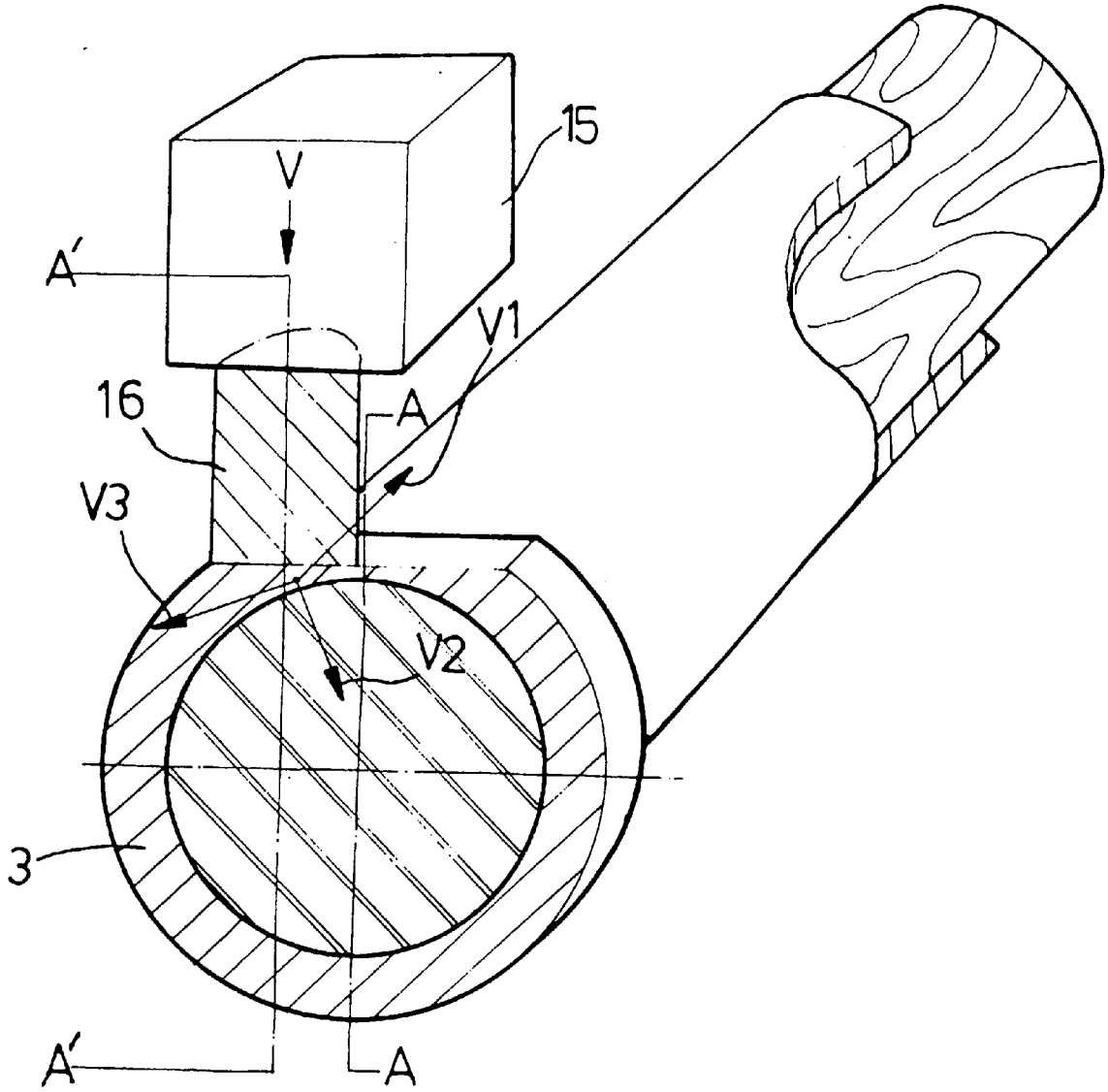
FIG. 3 is a perspective view of FIG. 2.
Figure 4:
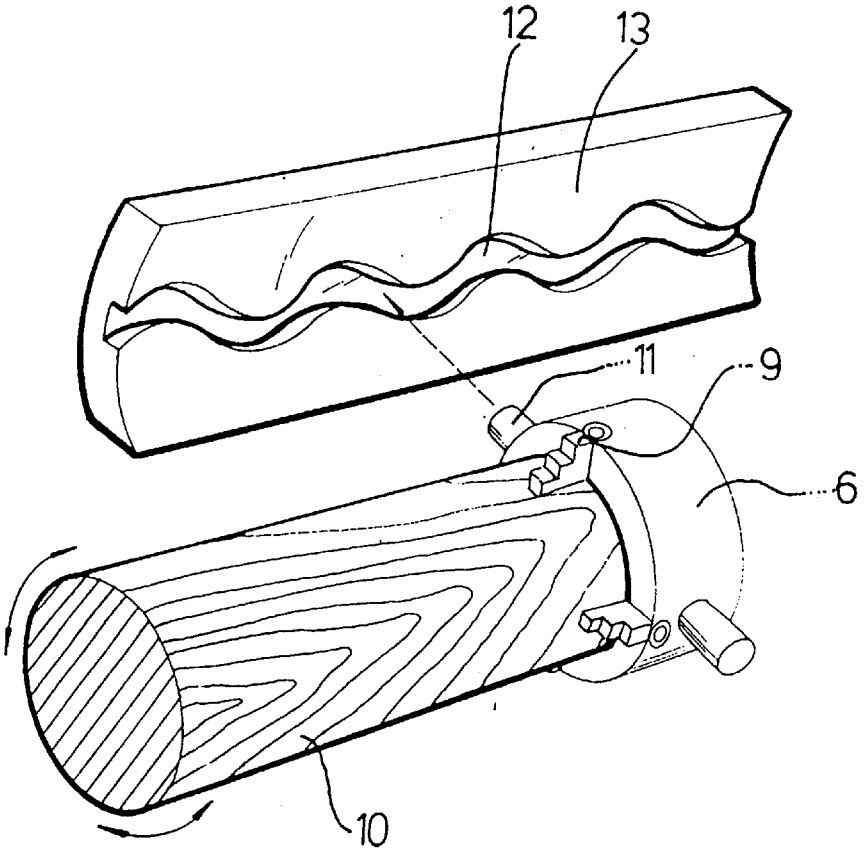
FIG. 4 is an enlarged view of a portion of the present invention.

FIG. 1 is a sectional view of a device in accordance with an embodiment of the present invention. In FIG. 1, a compression shape-forming mold 2 having a cylindrical pipe-type configuration with the ability to resist high intensity pressure, e.g., an iron pipe, is obliquely installed in the upper portion of a shape-forming device 1 so that a fixed gradient θ may be maintained. A plurality of holes 2*a* are disposed in the main surface of the compression shape-forming mold 2 for guiding sap removed from wood to a reception plate 14.

A cylindrical compression shape-forming die 3 into which a log is inserted is installed in the front of the compression shape-forming mold 2. An ultrasonic wave generator 15 is installed to the upper part of the shape-forming die 3, and an ultrasonic wave concentrator 16 is installed in a lower part of the ultrasonic wave generator 15 so as to be slightly inclined to one side of the axis direction of a wood 10.

At an open side of the shape-forming die 3, the wood 10 to be processed is introduced and at the rear of the wood an oil pressure piston 4 is provided with an axis direction 0—0' corresponding to that of the compression shape-forming mold 2 and the shape-forming die 3. In the front of the piston, a chuck 6 capable of holding the wood 10 is assembled with a washer 7, a bolt 8 and a jaw 9 with teeth to hold the wood 10 while it is rotating in the right and left directions.

A cam guide 13, which is fixed in the axial direction of the wood 10 is installed at one side of the chuck 6, and a cam slot 12 is provided within the cam guide 13 so that a cam 11, which extends from both sides of the chuck 6, is slidingly guided within the slot 12. The wood 10 is forcedly inserted into the compression shape-forming mold 2 while alternately rotating clockwise and counterclockwise; that is, performing a twist motion upon being pushed into the shape-forming die 3.

An explanation of the detailed method of hardening the fiber of the log will now be discussed using the aforementioned configuration of the device of the present invention.

The wood used in the present invention includes wood in a non-dried state as well as wood in a state right after being harvested.

In the present invention, the wood 10 to be processed is introduced to the opening pipe of the shape-forming die 3 so that the front of the wood 10 may be inserted thereto. The end of the wood 10 is held by the jaw 9 of the chuck 6 for insertion in the axial direction of the shape-forming mold 2 by applying a constant pressure with the piston 4. Since the cam 11 extending from the side of the chuck 6 is guided in the slot 12, the operation of the piston 4 causes the wood 10 to alternately rotate clockwise and counterclockwise; that is, perform a twisting motion. Simultaneously therewith, sound oscillation, generated from the ultrasonic wave generator 15, is applied to the wood 10 in three dimensions through the ultrasonic wave concentrator 16.

Since the ultrasonic wave concentrator 16 and the bilateral shape-forming die 3 are not connected together by a common axis but rather obliquely connected, a unilateral sound oscillation V generated in the ultrasonic wave generator 15 is divided into stereophonic sound oscillations $V_1$, $V_2$ and $V_3$. $V_1$ is transmitted in the axial direction of the shape-forming die 3, $V_2$ in a perpendicular direction to the shape-forming die 3, and $V_3$ in a tangent direction of the shape-forming die 3.

The characteristic of the stereophonic sound oscillations $V_1$, $V_2$ and $V_3$ transmitted to the shape-forming die 3 is that a sound wavelength transmitted in a perpendicular direction to the axis of the shape-forming die 3 is longer than the size of the surface of the shape-forming die 3.

Through the device of the present invention, the wood 10 provided in the shape-forming die 3 is contracted in the axial direction of the shape-forming die 3 by the constant pressure of the piston 4 and the stereophonic sound oscillations $V_1$, $V_2$ and $V_3$ and accordingly is introduced into the compression shape-forming mold 2 while being compressed to correspond with the shape of the opening of the shape-forming die 3. A uniform hardness and intensity over the overall volume of the wood is thus achieved. By the constant pressure in the axial direction, the stereophonic sound oscillation $V_1$, $V_2$ and $V_3$ transmitted to the ultrasonic concentrating device 16 and the shape-forming die 3 applied to the entire volume of wood 10 simultaneously in the axial direction, the perpendicular direction and the tangent direction, the density and the intensity of the fiber can be changed without destroying the structure of the wood.

Thus, the constant pressure and the stereophonic sound oscillation condense the biretta and pores which stored the water, whereby the water and sap is extracted from the wood 10 which hardens the wood without transforming the structure of the wood.

If the wood 10 is compressed without the application of the alternate rotation and the stereophonic sound oscillation, the frictional force resulting from contact with the inside wall of the compression shape-forming mold 2 makes transfer of the wood difficult. In this case, a high constant pressure has to be applied in the axial direction of the shape-forming die 3 and, thus the structure of the wood may be destroyed. Also, the quality of the wood may be transformed due to stress occurring in the wood.

However, in the present invention, since the wood 10 is compressed while being transferred by the stereophonic sound oscillation, the stereophonic sound oscillation is transmitted to the wood 10 and the frictional force is substantially reduced in the compression shape-forming mold 2. Also, the alternate rotational force is spontaneously generated by the cam reception slot 12 formed in the cam guide 13 while the wood 10 is linearly transferred. Accordingly, the friction with the inside wall of the compression shape-forming mold 2 is reduced by the sound oscillation, the constant pressure and the alternate, rotational force and thus the wood 10 is smoothly conveyed. Accordingly, the wood can be easily compressed by a small amount of pressure and also uniformly maintains the high density over the entire volume thereof without damage. In other words, since the stress applied to the wood due to the rotation oscillation has the effect of alternately shaking the wood 10 thereby, easily extracting the water from the wood, the wood is processed so as to maintain the uniform density and hardness thereof without being transformed.

The radiation surface of the ultrasonic wave concentrating device 16 is installed in an opening provided in the shape-forming die 3 where the wood 10 is inserted for maximizing the concentration of the sound energy to the opening of the shape-forming die 3. This achieves maximum efficiency of processing together with maintaining the most economical condition that the sound wavelength is transmitted.

As mentioned above, the alternate rotational force produced by the cam 11 and the cam guide4 13 is applied to the wood 10 as the constant pressure of the piston 4 is also applied to the wood in the shape-forming die 3, in the axis direction thereof. Simultaneously, the unilateral sound oscillation V generated in the ultrasonic wave generator 15 is concentrated in the ultrasonic wave concentrator 16 and the stereophonic sound oscillations $V_1$, $V_2$ and $V_3$ are transmitted to the wood 10 through the shape-forming die 3. Thus, the wood 10 is transferred to the compression shape-forming mold 2 while being compressed in the same shape as the shape-forming die 3. The wood processed through the above method can be used as a high quality wood having uniform density and hardness.

In the present invention, the water contained in the wood is removed during the compression process through the holes 2*a* of the compression shape-forming mold 2 and accordingly the water extracted from the wood can be used as a health beverage after special processing.

Accordingly, the inventive compressing method achieves an additional economic benefit capable of producing a health beverage utilizing the water extracting device.

EXAMPLE

A semimanufactured piece of aspen wood (diameter: 61 mm, length: 500 mm, 0.42 g/cm$^3$) is inserted into a conical opening of a shape-forming device having a diameter of 54 mm. A constant pressure of 4900 kg is applied to the wood by a piston 4 at a speed of 61 m/ml.sec while a sound wavelength is transmitted to the ultrasonic wave concentrator. Simultaneously with this, the semimanufactured goods are alternatively rotated as mentioned above, and the first rotation angle is set to 0.9°, and when the semimanufactured goods enter into the shape-forming device, it is set at 0.2°. The linear speed of alternate rotation is set to 0.12/sec.

As a result of drying the product after compression processing, the density of the wooden product is increased by 1.5 times, the diameter becomes 53 m/m, the durability is increased 2.0 times and the intensity is increased by 1.8 times.

Through an X-ray photograph, it is ascertained that the structure of the wood is uniformly compressed.

The difference in the density from the surface to the center reaches from 8% to 10%, and in case of a long piece of wood, more excellent results can be obtained.

Meanwhile, in the case of compressing the wood without the application of the alternate rotation, the constant pressure had to be set at 7000 kg, and the speed of the piston had to be set to 3 mm/sec for increasing the density of the product by 1.5 times. Accordingly, it is determined that sound oscillation and the alternate rotation are very efficient elements in the compression processing of wood.

In the processing process of forcedly compressing the wood, the sound oscillation increases the compression effect of the wood by accelerating the molecular movement which makes the structure of the wood compact. That is, if the sound oscillation is applied to a molecular structure of the wood, the molecular movement of the wood is accelerated and then if constant pressure by the piston 4 and the alternate rotation are applied to the compression shape-forming mold 2, the most fragile birettas containing water in the structure of the wood, i.e., in the pores of the wood< are easily compressed, whereby the water is forcedly extracted causing the volume of the birettas occupied by the water to contract.

Particularly, in the present invention, the ultrasonic wave is not applied to the center part of the wood 10 but rather is obliquely transmitted thereto by the bilateral shape-forming die 3. Accordingly, there is the advantage of uniformly transmitting sound oscillation to the structure of the wood to obtain a uniform contraction density.

Through the present invention, since processed wood is immediately treated, the drying process which normally lasts for a long time is not required. The present invention is very economically efficient in producing a dense wooden product. Particularly, the present invention has the advantage of producing a wooden product substantially free from flaws such as crevices, distortions and transformation and accordingly can be used in many fields, for example, for building materials, furniture, etc.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A device for increasing the hardness and intensity of wood which comprises chuck means for holding the wood in a fixed position for processing;

a compression-shaped forming die for compressing the wood being processed, an ultrasonic wave-generating device operatively connected with the compression-shaped forming die for applying sound waves to the wood, a forming mold positioned downstream of said compression-shaped forming die for receiving wood therefrom, said forming mold further compressing said wood to remove a portion of the water contained therein, and means for advancing the chuck means containing the wood being processed through the compression-shaped forming die, the ultrasonic wave-generating device and the forming mold.

2. The device of claim 1, wherein the ultrasonic wave-generating device further contains an ultrasonic wave concentrator operatively associated therewith.

3. The device of claim 1, wherein a cam guide containing a slot is positioned at one side of the chuck means, said chuck means containing a cam extending therefrom for engagement with said slot.

4. The device of claim 1, wherein the slot has a serpentine configuration so that the chuck means, when engaged in said slot twists the wood held in the chuck means alternately in the clockwise and counterclockwise directions.

5. The device of claim 1, wherein the forming mold contains a plurality of holes for removing water compressed from the wood.

6. The device of clam 1, wherein the ultrasonic wave-generating device and the ultrasonic wave concentrator are disposed to be inclined to one side of the axial direction of the wood.

7. The device of claim 1, wherein the chuck means contains teeth to facilitate holding the wood.

8. The device of claim 1, wherein the advancing means is a piston.

9. A method of processing wood to increase its hardness and intensity utilizing a chuck means, a compression-shaped forming die, an ultrasonic wave generating device, a forming mold and a piston means which comprises fixing the wood to be processed in a chuck means, advancing the wood with twisting to a compression-shaped forming die for further compression, treating the wood in the compression-shaped forming die with ultrasonic waves and further compressing the wood in a forming mold while removing water therefrom.

10. The method of claim 9, wherein the ultrasonic waves are applied to the wood in three dimensions.

11. The method of claim 10, wherein the ultrasonic waves are transmitted in an axial direction of the shape-forming die, in a perpendicular direction to the shape-forming die and in a tangential direction of the shape-forming die.

12. The method of claim 1, wherein the piston means is utilized to advance and compress the wood as it is conveyed through the compression-shaped forming die, the ultrasonic wave-generating device and the forming mold.

13. The method of claim 1, wherein the generated ultrasonic waves are further concentrated prior to or simultaneously with treating the wood.

* * * * *